US011802560B2

(12) United States Patent
Wang et al.

(10) Patent No.: US 11,802,560 B2
(45) Date of Patent: Oct. 31, 2023

(54) HYDROSTATIC PRESSURE SUPPORT FOR SPHERICAL PUMP ROTOR AND SPHERICAL PUMP WITH SAME

(71) Applicant: SHENZHEN SPHERICAL FLUID POWER TECHNOLOGY CO., LTD., Guangdong (CN)

(72) Inventors: Luyi Wang, Shenzhen (CN); Wuxing Zhang, Shenzhen (CN)

(73) Assignee: SHENZHEN SPHERICAL FLUID POWER TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 17/728,939

(22) Filed: Apr. 25, 2022

(65) Prior Publication Data

US 2022/0252068 A1 Aug. 11, 2022

Related U.S. Application Data

(63) Continuation of application No. PCT/CN2020/122673, filed on Oct. 22, 2020.

(30) Foreign Application Priority Data

Nov. 1, 2019 (CN) ..... 201911060871.1
Nov. 1, 2019 (CN) ..... 201911061558.X

(51) Int. Cl.
*F03C 4/00* (2006.01)
*F04C 3/06* (2006.01)
(Continued)

(52) U.S. Cl.
CPC ..... *F04C 15/0042* (2013.01); *F04C 3/06* (2013.01); *F04C 15/0096* (2013.01);
(Continued)

(58) Field of Classification Search
CPC ..... F04C 18/48; F04C 18/50; F04C 18/54; F04C 21/005; F04C 29/0021;
(Continued)

(56) References Cited

U.S. PATENT DOCUMENTS 3,685,874 A * 8/1972 Gerard ..... F16C 32/0651 384/114
4,185,878 A * 1/1980 Robert ..... F16C 32/0648 384/120
(Continued)

FOREIGN PATENT DOCUMENTS

CN 201187446 Y 1/2009
CN 10601497 A * 10/2016 ..... F04C 15/0096
(Continued)

OTHER PUBLICATIONS

CN106014973A—Liu et al.—Ball Pump with Intermittent Cooling Function—Oct. 12, 2016—the English Machine Translation. (Year: 2016).*
(Continued)

*Primary Examiner* — Theresa Trieu

(57) ABSTRACT

Disclosed are a hydrostatic pressure support and a spherical pump having the same. The hydrostatic pressure support is arranged between each of two parallel sides of a slipper and a sliding groove, and includes a first liquid flow channel, a second liquid flow channel, and a pressure-bearing groove. An inlet of the first liquid flow channel is communicated with one of two working chambers of the spherical pump, and an inlet of the second liquid flow channel is communicated with the other of the two working chambers. An outlet of the first liquid flow channel and an outlet the second liquid flow channel are respectively communicated with the pressure-bearing grooves provided on the two parallel sides of the slipper.

17 Claims, 11 Drawing Sheets

(51) Int. Cl.

| | |
|---|---|
| ***F04C 29/00*** | (2006.01) |
| ***F04C 15/00*** | (2006.01) |
| ***F04C 15/06*** | (2006.01) |
| ***F04C 18/48*** | (2006.01) |

(52) U.S. Cl.
CPC ..... *F04C 15/06* (2013.01); *F04C 18/48* (2013.01); *F04C 2240/54* (2013.01); *F04C 2240/60* (2013.01); *F04C 2250/20* (2013.01)

(58) Field of Classification Search
CPC ..... F04C 29/0071; F04C 29/04; F04C 29/12; F04C 15/0042; F04C 15/0096; F04C 15/06; F04C 2240/50; F04C 2240/54; F04C 2240/60; F04C 2250/20; F04C 3/00; F04C 3/02; F04C 3/06; F16C 32/06; F16C 32/0633; F16C 32/064; F16C 32/0651–0659; F16C 32/0681; F16C 32/0865
See application file for complete search history.

(56) References Cited

U.S. PATENT DOCUMENTS

| | | | | |
|---|---|---|---|---|
| 4,915,510 | A * | 4/1990 | Arvidsson | F16C 32/0644 384/99 |
| 6,442,935 | B1 * | 9/2002 | Larsen | F04C 18/54 418/68 |
| 2002/0081044 | A1 * | 6/2002 | Shima | F16C 32/0651 384/100 |
| 2008/0219876 | A1 * | 9/2008 | Arnold | F04C 18/54 418/68 |
| 2010/0233000 | A1 | 9/2010 | Arnold | |
| 2016/0333879 | A1 * | 11/2016 | Wang | F04C 18/54 |

FOREIGN PATENT DOCUMENTS

| | | | | | |
|---|---|---|---|---|---|
| CN | 109611330 | A | * | 4/2019 | F04C 15/0096 |
| CN | 109707622 | A | | 5/2019 | |
| CN | 209494702 | U | | 10/2019 | |
| CN | 110671319 | A | | 1/2020 | |
| CN | 110701040 | A | | 1/2020 | |
| CN | 111164311 | A | * | 5/2020 | F04C 15/064 |
| CN | 210769291 | U | | 6/2020 | |
| CN | 210977849 | U | | 7/2020 | |
| GB | 986700 | A | | 3/1965 | |
| WO | WO-2017181825 | A1 | * | 10/2017 | F04C 18/48 |

OTHER PUBLICATIONS

CN109611330A—Zhang et al.—Bi-directional Rotating Spherical Pump Cooling Mechanism—Apr. 12, 2019—the English Machine Translation. (Year: 2019).*
CN-111164311-A—Nickel et al.—Rotary Piston Pump for Fluid—May 15, 2020—the English Machine Translation. (Year: 2020).*
WO-2017181825-A1—Wang et al.—Spherical Compressor—Oct. 26, 2017—the English Machine Translation. (Year: 2017).*

* cited by examiner

HYDROSTATIC PRESSURE SUPPORT FOR SPHERICAL PUMP ROTOR AND SPHERICAL PUMP WITH SAME

CROSS-REFERENCE TO RELATED APPLICATIONS

This application is a continuation of International Patent Application No. PCT/CN2020/122673, filed on Oct. 22, 2020, which claims the benefit of priority from Chinese Patent Application Nos. 201911060871.1 and 201911061558.X, both filed on Nov. 1, 2019. The content of the aforementioned application, including any intervening amendments thereto, is incorporated herein by reference in its entirety.

TECHNICAL FIELD

This application relates to variable displacement mechanisms, and more particularly to a hydrostatic pressure support for a spherical pump rotor and a spherical pump with the same.

BACKGROUND

Spherical pump is an emerging positive displacement mechanism, which has no intake/exhaust valves and few moving parts. The moving parts are in surface contact (namely, forming a surface sealing structure), which can achieve the high-pressure condition and structural miniaturization. Currently, the spherical pump has been extensively applied in practice. Nevertheless, there is a fixed angle between the piston axis and the main shaft, and the pressure in the two working chambers experiences a back-and-forth change, such that there is a pressure difference between the two chambers. As a result, the piston and the rotating disc will deflect toward the lower pressure side to squeeze the spherical surface of the cylinder body to render the gap between the rotating disc and the spherical surface of the cylinder body smaller, which will cause damages to the oil film or water film, and an increase in the friction force, leading to increased energy consumption, and serious abrasion of the rotor and the slipper.

SUMMARY

A first object of the present disclosure is to provide a hydrostatic pressure support, which is provided on the slipper of the spherical pump rotor to balance the unbalanced force during the operation by means of the hydraulic pressure generated by the spherical pump, facilitating reducing the energy consumption and prolonging the service life of the spherical pump.

A second object of the present disclosure is to provide a spherical pump, whose rotor slipper is provided with the hydrostatic pressure support to balance the unbalanced force during the operation by means of the hydraulic pressure generated by the spherical pump, facilitating reducing the energy consumption and prolonging the service life of the spherical pump.

Technical solutions of the present disclosure are described as follows.

This application provides a hydrostatic pressure support for a rotor of a spherical pump, comprising:

a first liquid flow channel;

a second liquid flow channel; and a pressure-bearing groove;

wherein the first liquid flow channel and the second liquid flow channel are both arranged on a rotating disc; two parallel sides of a slipper of the rotor are respectively provided with the pressure-bearing groove; the first liquid flow channel comprises a first inlet and a first outlet; the first inlet is communicated with a first working chamber of the spherical pump; the second liquid flow channel comprises a second inlet and a second outlet; the second inlet is communicated with a second working chamber of the spherical pump; the first outlet and the second outlet are respectively communicated with pressure-bearing grooves on the two parallel sides of the slipper; a slipper liner is arranged between each of the two parallel sides of the slipper and a sliding groove of the spherical pump; the two parallel sides of the slipper respectively fit with slipper liners on both sides; the slipper is configured to slide back and forth in the sliding groove along surfaces of the slipper liners; and the hydrostatic pressure support is arranged between each of the two parallel sides of the slipper and a corresponding slipper liner.

This application also provides a spherical pump having a hydrostatic pressure support, comprising:

a cylinder body having a semi-spherical inner cavity;

a cylinder cover having a semi-spherical inner cavity;

a piston;

a rotating disc;

a main shaft; and a main shaft bracket;

wherein the cylinder body is provided with a through hole communicated with an outside, and the through hole is configured to allow a rotating disc shaft to pass through;

a lower end of the cylinder cover is fixedly connected to an upper end of the cylinder body to form a spherical inner cavity; an inner spherical surface of the cylinder cover is provided with a piston shaft hole, a waist-shaped inlet hole, and a waist-shaped outlet hole; the waist-shaped inlet hole and the waist-shaped outlet hole are arranged in an annular area perpendicular to an axis of the piston shaft hole; and the waist-shaped inlet hole is in communication with a suction port at an upper end of the cylinder cover, and the waist-shaped outlet hole is in communication with a discharge port at the upper end of the cylinder cover;

the piston comprises a spherical top surface, two side surfaces at an angle, and a first pin seat at a lower portion of the two side surfaces; a piston shaft protrudes from a middle of the spherical top surface of the piston; an axis of the piston shaft passes through a sphere center of the spherical top surface of the piston; and the spherical top surface of the piston and the spherical inner cavity have the same sphere center, and the spherical top surface of the piston is in a sealing movable fit with the spherical inner cavity;

an outer circumference between an upper portion and a lower end surface of the rotating disc is configured as a spherical surface; the spherical surface of the rotating disc and the spherical inner cavity have the same sphere center, and the spherical surface of the rotating disc is in a sealing movable fit with the spherical inner cavity; a second pin seat corresponding to the first pin seat is provided at the upper portion of the rotating disc; a rotating disc shaft protrudes from a center of a lower end of the rotating disc, and the rotating disc shaft passes through a sphere center of the spherical surface of the rotating disc; and a slipper is fixedly provided at an end of the rotating disc shaft;

the main shaft is connected to a lower end of the cylinder body through the main shaft bracket; the main shaft bracket is fixedly connected to the lower end of the cylinder body, and is configured to provide support for rotation of the main shaft; an upper end surface of the main shaft is provided with a sliding groove; and a lower end of the main shaft is connected to a power mechanism; and the axis of the piston shaft hole and an axis of the rotary table shaft both pass through a sphere center of the spherical inner cavity; the axis of the piston shaft hole has an angle with respect to an axis of the main shaft; the second pin seat and the first pin seat are matched to form a cylindrical hinge; individual matching surfaces of the cylindrical hinge are in a sealing movable fit; the rotating disc shaft extends from the lower end of the cylinder body, and the slipper is inserted into the sliding groove at the upper end of the main shaft; two parallel sides of the slipper are respectively in a sliding fit with two sides of the sliding groove; the two parallel sides of the slipper are symmetrically arranged with respect to an axis of the rotating disc, and are parallel to an axis of the cylindrical hinge; when the main shaft rotates to drive the rotating disc and the piston, the slipper slides back and forth in the sliding groove, and the piston and the rotating disc swing in relation to each other; two working chambers with alternately-variable volumes are formed between an upper end surface of the rotating disc, the two side surfaces of the piston and the spherical inner cavity; the hydrostatic pressure support is arranged between each of the two parallel sides of the slipper and the sliding groove; the hydrostatic pressure support comprises a first liquid flow channel, a second liquid flow channel, and a pressure-bearing groove; the first liquid flow channel and the second liquid flow channel are both arranged on the rotating disc; the two parallel sides of the slipper are respectively provided with the pressure-bearing groove; the first liquid flow channel comprises a first inlet and a first outlet; the first inlet is communicated with one of the two working chambers; the second liquid flow channel comprises a second inlet and a second outlet; the second inlet is communicated with the other of the two working chambers; and the first outlet and the second outlet are respectively communicated with pressure-bearing grooves provided on the two parallel sides of the slipper.

Compared to the prior art, the present disclosure has the following beneficial effects.

(1) By arranging the hydrostatic pressure support on the slipper, a larger balancing force can be applied on the rotating disc due to the leverage, which can eliminate the unbalanced forces caused by the asymmetrical compression of the two working chambers during the rotor rotation.

(2) A uniform gap is enabled between the spherical surface of the piston, the spherical surface of the rotating disc, and the spherical inner cavity, reducing the friction force and friction loss.

(3) The friction between the slipper and the sliding groove is relieved.

(4) The unbalanced force during the operation of the spherical pump is eliminated, ensuring the uniform gap between the matching surfaces, reducing the power consumption of the spherical pump, improving the cooling and lubrication conditions, and prolonging the service life of the parts.

(5) The hydrostatic pressure support can be applied to oil pumps and water pumps.

BRIEF DESCRIPTION OF THE DRAWINGS

The embodiments of the disclosure will be illustrated in detail below with reference to the accompanying drawings.

Figure 1:
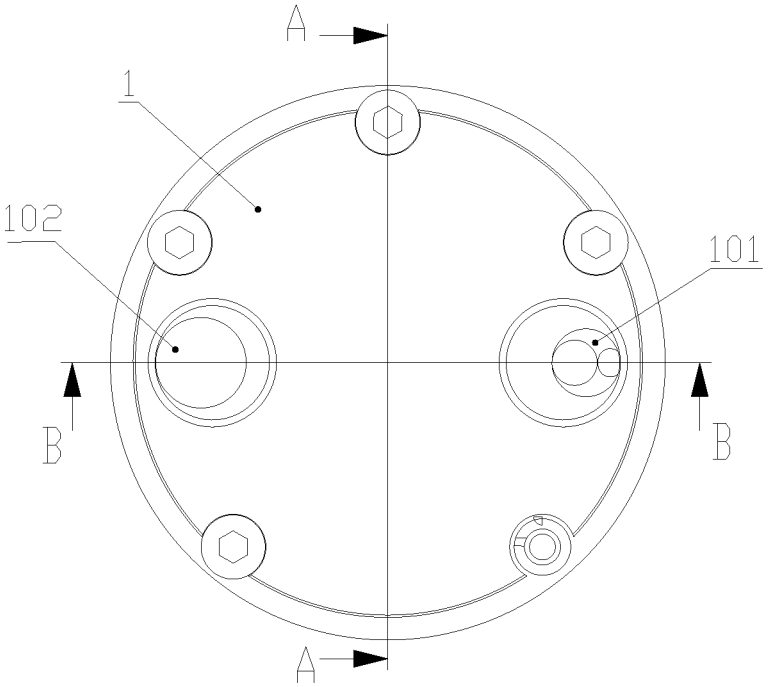
FIG. 1 is a structural diagram of a spherical pump according to an embodiment of the present disclosure.

In the drawings: 1, cylinder cover; 2, piston; 3, central pin; 4, rotating disc; 5, cylinder body; 6, main shaft; 7, main shaft bracket; 8, bearing; 9, sealing ring; 10, slipper liner; 11, cylinder liner; 101, suction port; 1011, throttling step; 102, discharge port; 103, first diversion channel; 104, piston shaft hole; 105, waist-shaped inlet hole; 106, waist-shaped outlet hole; 107, first returning channel; 108, chip groove; 201, piston main body; 202, first PEEK layer; 2021, spherical top surface; 203, piston shaft; 204, first pin seat; 2041, side surface; 205, first pin hole; 206, opening; 401, rotating disc main body; 402, second PEEK layer; 403, slipper; 404, first liquid flow channel; 4041, first inlet; 4042, first outlet; 405, second liquid flow channel; 4051, second inlet; 4052, second outlet; 406, first pressure-bearing groove; 407, second pressure-bearing groove; 408, first multi-stage rectangular groove; 4081, first rectangular primary pressure-bearing groove; 4082, first rectangular auxiliary pressure-bearing groove; 409, second multi-stage rectangular groove; 4091, second rectangular primary pressure-bearing groove; 4092, second rectangular auxiliary pressure-bearing groove; 410, first multi-stage circular groove; 4101, first circular primary pressure-bearing groove; 4102, first circular auxiliary pressure-bearing groove; 411, second multi-stage circular groove; 4111, second circular primary pressure-bearing groove; 4112, second circular auxiliary pressure-bearing groove; 412, rotating disc shaft; 413, second pin hole; 414, second pin seat; 501, second diversion channel; 502, second returning channel; 503, through hole; 601, sliding groove; 602, overflow hole; 701, returning groove; and 1001, working chamber.

DETAILED DESCRIPTION OF EMBODIMENTS

To render the technical solutions, objects and advantages of the present disclosure clearer, the embodiments of the disclosure will be described in detail below with reference to the accompanying drawings.

Figure 2:
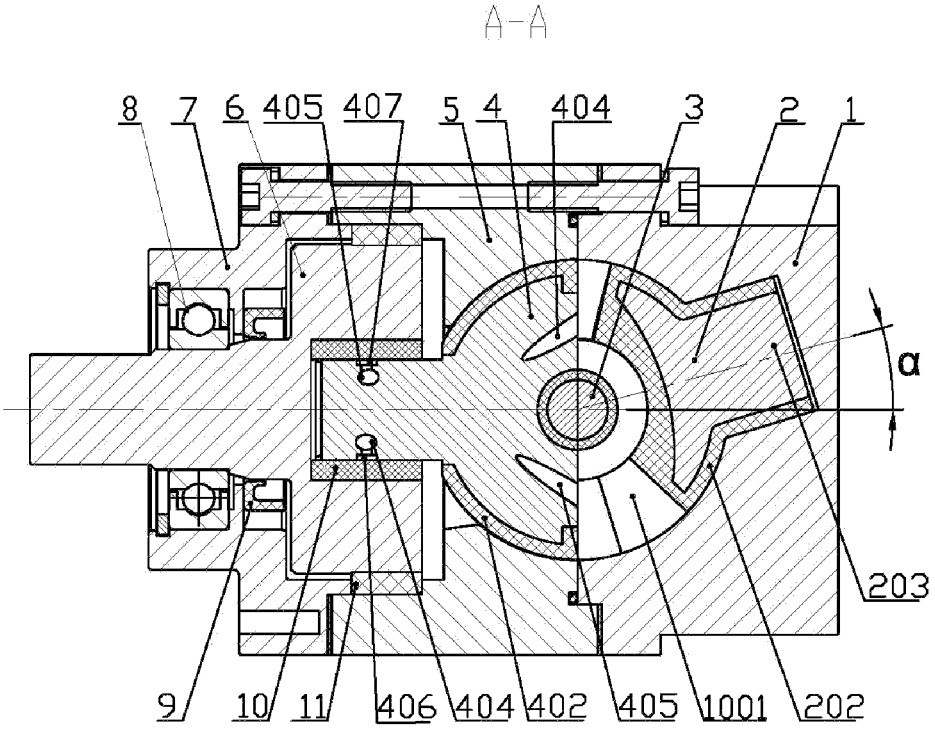
FIG. 2 is cross-sectional view of the spherical pump along the line A-A in FIG. 1.
Figure 3:
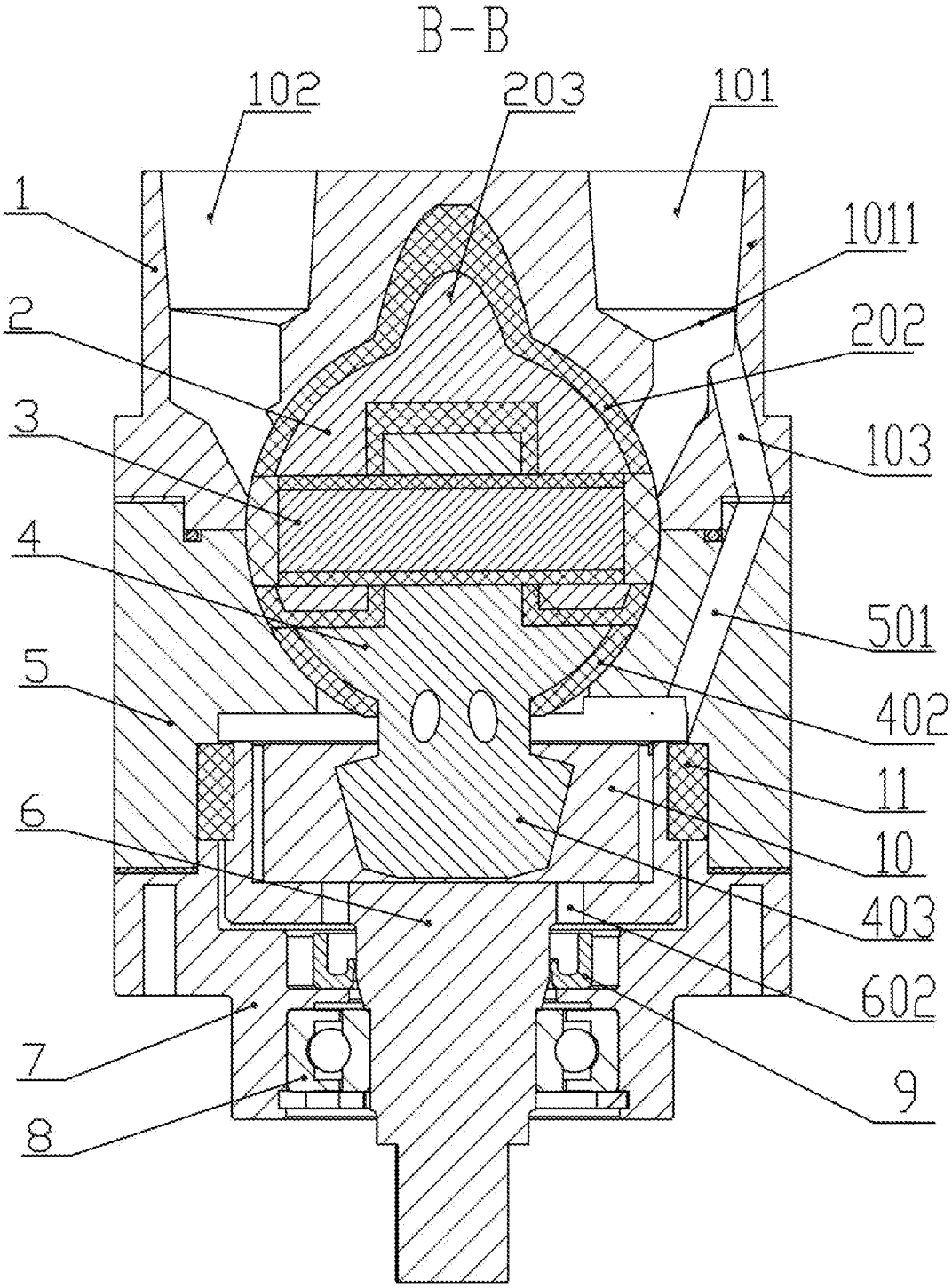
FIG. 3 is cross-sectional view of the spherical pump along the line B-B in FIG. 1.

As shown in FIGS. 1-3, a spherical pump provided herein includes a cylinder cover 1, a piston 2, a rotating disc 4, a cylinder body 5, a main shaft 6, and a main shaft bracket 7. Both the cylinder body 5 and the cylinder cover 1 have a hemi-spherical inner cavity. The cylinder body 5, the cylinder cover 1, and the main shaft bracket 7 are sequentially connected by screws to form a spherical pump casing having a spherical inner cavity, that is, a spherical pump stator. The piston 2, the rotating disc 4 and the main shaft 6 are connected in sequence to form a spherical pump rotor. The main shaft bracket 7 is configured to provide support for the rotation of the main shaft 6, and is fixedly connected to a lower end of the cylinder body 5 by screws. The piston 2 and the rotating disc 4 are hinged via a central pin 3, and the piston shaft 203 is inserted into the piston shaft hole 104 inside the cylinder cover 1. A slipper 403 at a lower end of the rotating disc shaft is inserted into a sliding groove 601 at an upper end of the main shaft 6.

Figure 4:
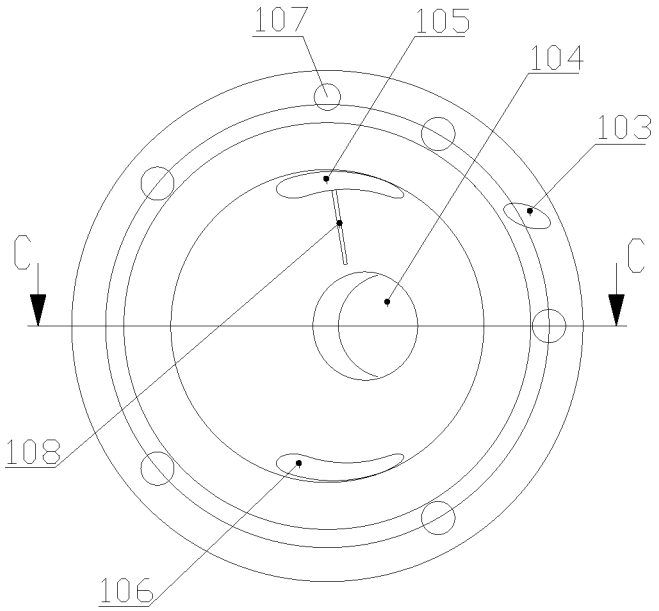
FIG. 4 is a structural diagram of a cylinder cover according to an embodiment of the present disclosure.
Figure 5:
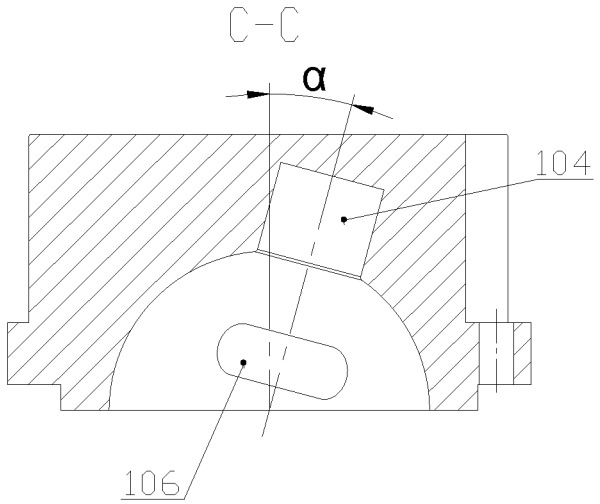
FIG. 5 is a cross-sectional view of the cylinder cover along the line C-C in FIG. 4.

As shown in FIGS. 4-5, an upper end of the cylinder cover 1 is provided with a suction port 101 and a discharge port 102, and an inner spherical surface of the cylinder cover 1 is provided with a waist-shaped inlet hole 105, a waist-shaped outlet hole 106 and a piston shaft hole 104. An axis of the piston shaft hole 104 passes through the sphere center of the inner spherical surface of the cylinder cover 1. The waist-shaped inlet hole 105 and the waist-shaped outlet hole 106 are arranged in an annular area perpendicular to the axis of the piston shaft hole 104. The waist-shaped inlet hole 105 is in communication with the suction port 101 at the upper end of the cylinder cover 1, and the waist-shaped outlet hole 106 is in communication with the discharge port 102 at the upper end of the cylinder cover 1. The suction/discharge of liquid is realized by controlling the rotation of the piston 2. When it is required to suck or discharge the liquid, the working chamber is connected to the waist-shaped inlet hole 105 or the waist-shaped outlet hole 106. To prevent chips generated by the rotation of the piston shaft 203 in the piston shaft hole 104 from entering a gap between the outer spherical surface of the piston 2 and the inner spherical surface of the cylinder cover 1, a chip groove 108 is provided on the inner spherical surface of the cylinder cover 1. One end of the chip groove 108 is communicated with the waist-shaped inlet hole 105, the other end of the chip groove 108 extends near to the opening of the piston shaft hole 104 along the inner spherical surface of the cylinder cover 1 in the direction of the piston shaft hole 104. The cross section of the chip groove 108 is U-shaped, and the U-shaped opening is located on the inner spherical surface of the cylinder cover 1. The cross-sectional sizes of the chip groove 108 (i.e., depth and width) are designed based on the principle that the spherical pump is non-leakage. The chip groove 108 can be communicated with the piston shaft hole 104 or not communicated with the piston shaft hole 104. In this manner, chips discharged from the piston shaft hole 104 gather in the chip groove 108, enter the working chamber 1001 with the liquid, and flow with the liquid to be out of the cylinder.

Figure 6:
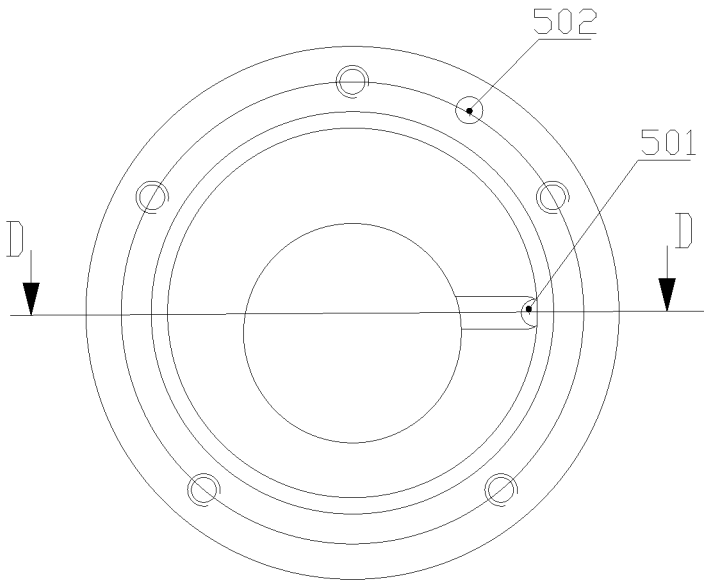
FIG. 6 is a schematic diagram of a cylinder body according to an embodiment of the present disclosure.
Figure 7:
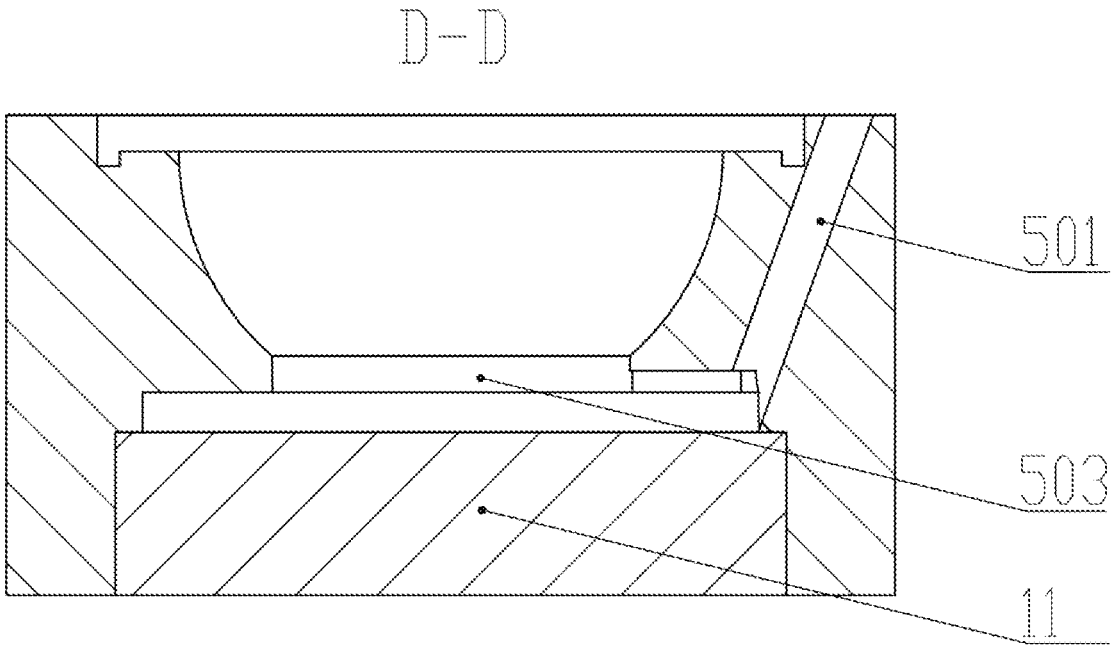
FIG. 7 is a cross-sectional view of the cylinder body along the line D-D in FIG. 6.
Figure 8:
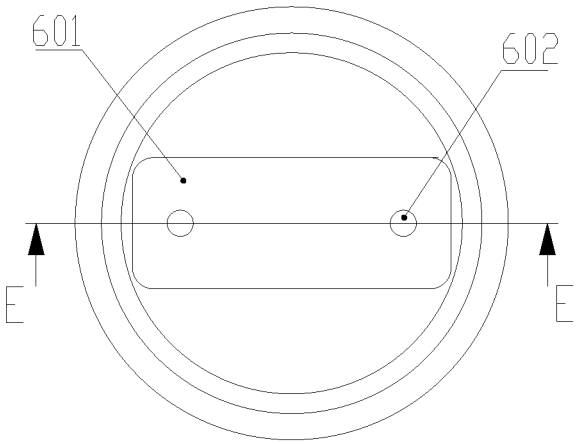
FIG. 8 is a schematic diagram of a main shaft according to an embodiment of the present disclosure.
Figure 9:
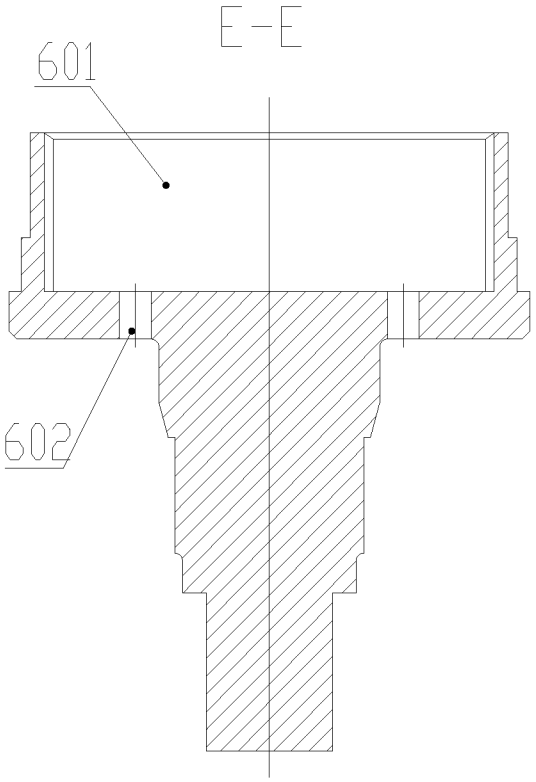
FIG. 9 is a cross-sectional view of the main shaft along the line E-E in FIG. 8.
Figure 10:
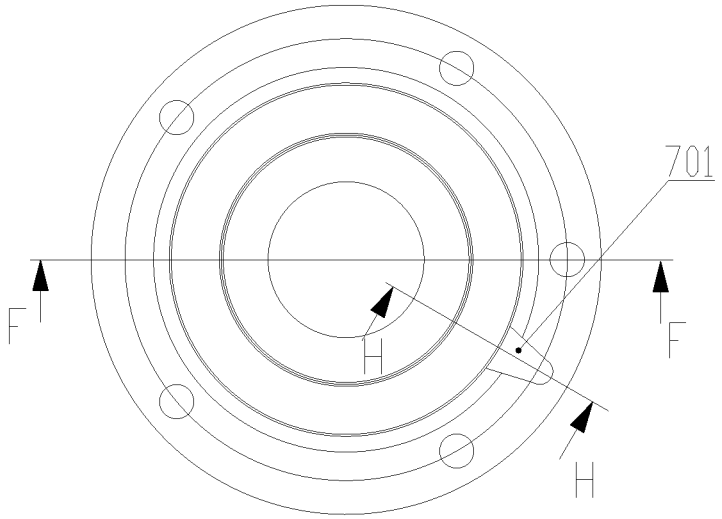
FIG. 10 is a schematic diagram of a main shaft bracket according to an embodiment of the present disclosure.
Figure 11:
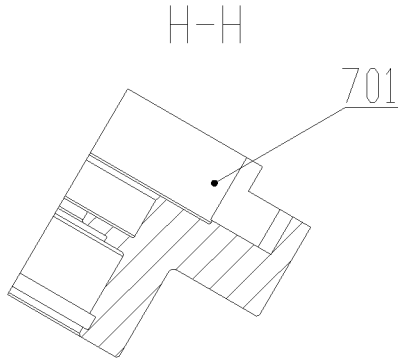
FIG. 11 is a cross-sectional view of the main shaft bracket along the line H-H in FIG. 10.
Figure 12:
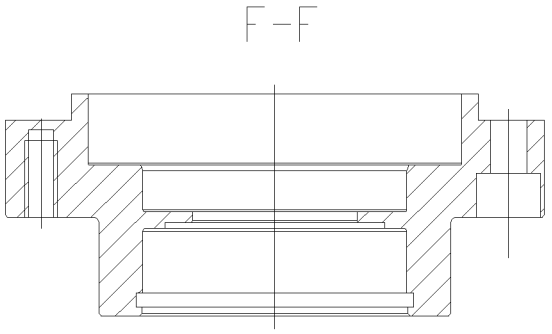
FIG. 12 is a cross-sectional view of the main shaft bracket along line F-F in FIG. 10.

As shown in FIGS. 6-7, the lower end of the cylinder body 5 is provided with a through hole 503 communicated with the outside, and the through hole 503 is configured to allow a rotating disc shaft to pass through. The size of the through hole 503 is designed to ensure that the rotating disc shaft does not interact with the cylinder body 5 during the rotation of the rotating disc 4. A part where the main shaft 6 and the lower end of the cylinder body 5 are matched is provided with a cylinder liner 11. A cylinder liner hole is provided at the lower end of the cylinder body 5, and the cylinder liner 11 is placed in the cylinder liner hole configuring for a rotating support for the upper end of the main shaft 6 (equivalent to a sliding bearing) during rotation of the main shaft 6. The axes of the cylinder liner hole, the cylinder liner 11 and the main shaft 6 are coincided, and both pass through the sphere center of the inner spherical surface of the cylinder. The inner diameter of the cylinder liner 11 is matched with the upper shaft neck of the main shaft 6, and the outer diameter of the cylinder liner 11 is matched with the inner diameter of the cylinder liner hole. The cylinder liner 11 is cylindrical, and made of poly(ether-ether-ketone) (PEEK). The outer cylindrical surface and the inner cylindrical surface of the cylinder liner 11 are respectively provided with a cooling groove penetrating along the axial direction of the cylinder liner 11, which are configured to cool and lubricate the main shaft 6 and the cylinder liner 11 through the cooling liquid.

Figure 13:
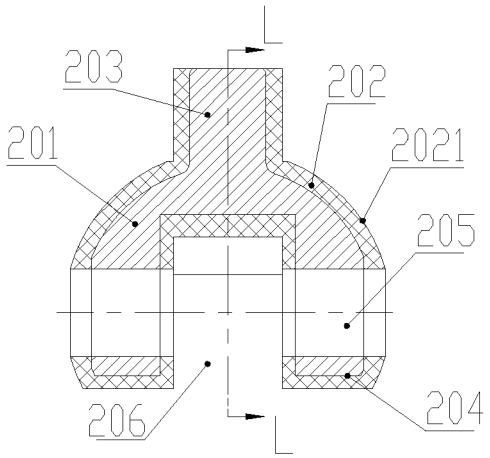
FIG. 13 is a cross-sectional view of a piston according to an embodiment of the present disclosure.
Figure 14:
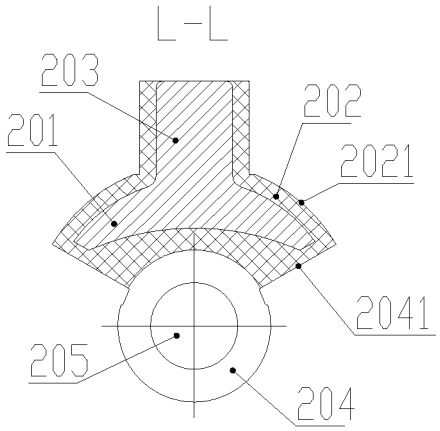
FIG. 14 is a cross-sectional view of the piston along the line L-L in FIG. 13.
Figure 15:
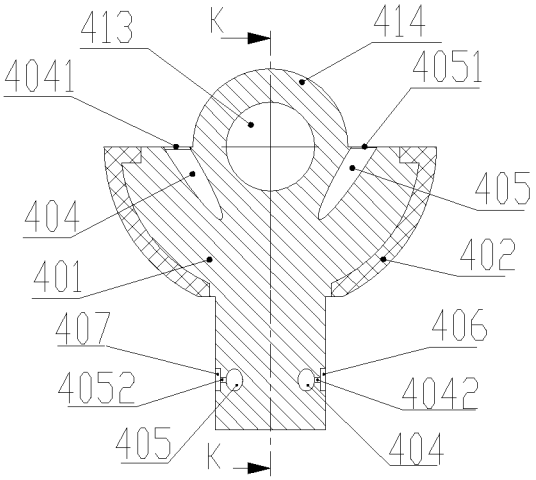
FIG. 15 is a cross-sectional view of a rotating disc according to an embodiment of the present disclosure.
Figure 16:
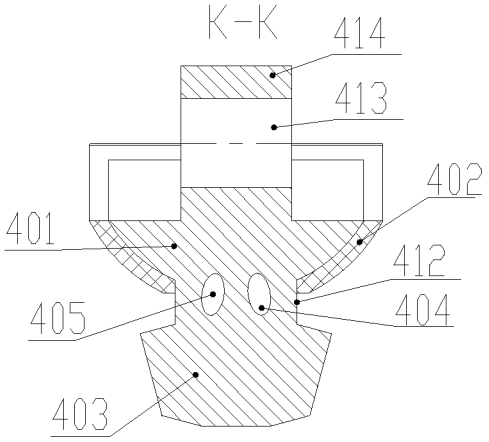
FIG. 16 is a cross-sectional view of the rotating disc along the line K-K in FIG. 15.
Figure 17:
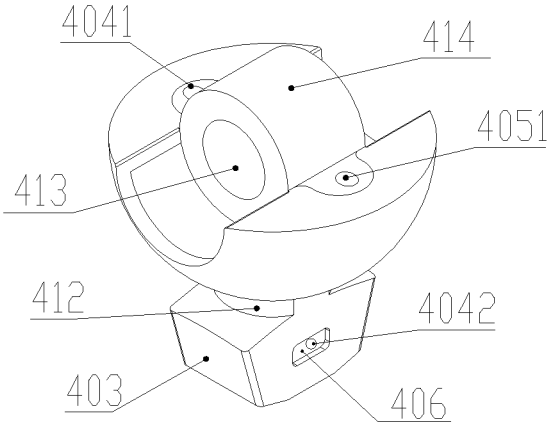
FIG. 17 is a perspective view of the rotating disc according to an embodiment of the present disclosure.
Figure 18:
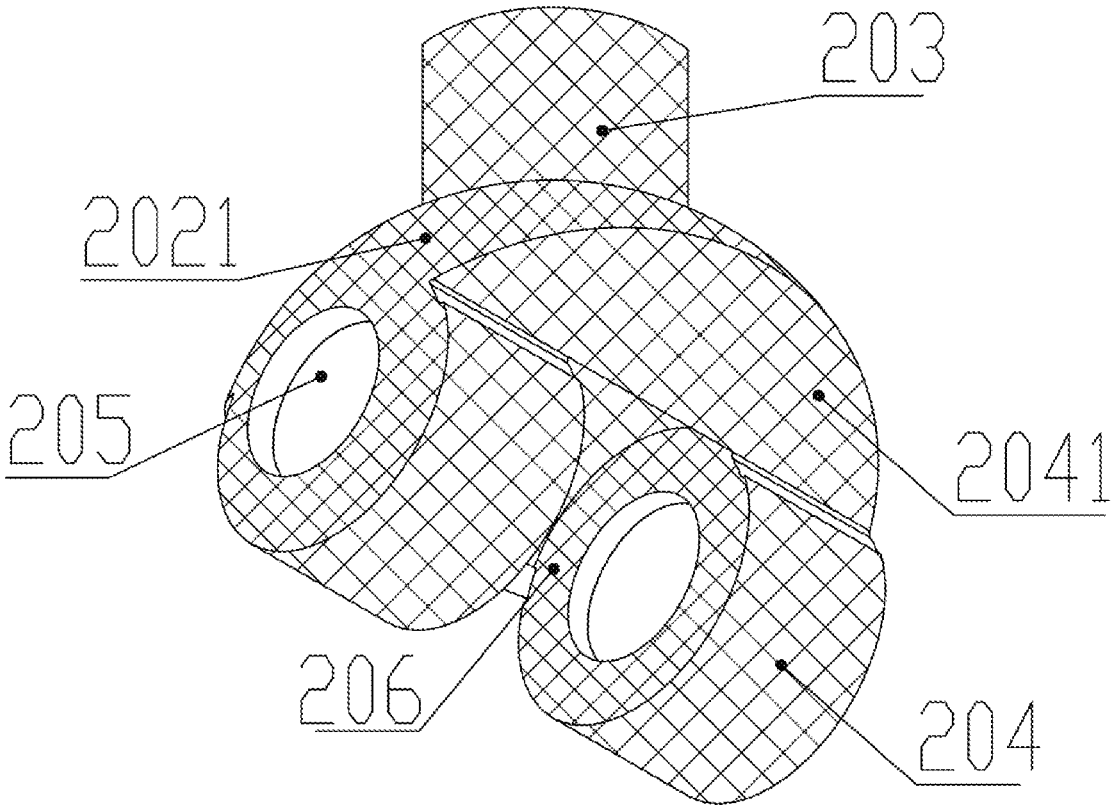
FIG. 18 is a perspective view of the piston according to an embodiment of the present disclosure.

As shown in FIGS. 13-14, the piston 2 has a spherical top surface 2021, two side surfaces 2041 at an angle $\alpha$ (10-25°), and a first pin seat is provided 204 at the lower portion of the two side surfaces 2041. A piston shaft 203 protrudes from a middle of the spherical top surface 2021 of the piston 2. The axis of the piston shaft 203 passes through the sphere center of the spherical top surface 2021 of the piston 2. The piston shaft 203 is inserted into the piston shaft hole 104 on the inner spherical surface of the cylinder cover 1. The spherical top surface 2021 of the piston 2 and the spherical inner cavity of the cylinder cover 1 have the same sphere center, and the spherical top surface 2021 of the piston 2 is in a sealing movable fit with the spherical inner cavity of the cylinder cover 1. The first pin seat 204 is semi-cylindrical, and provided with a first pin hole 205 penetrating along the central axis of the piston pin seat 204. An opening 206 is provided on the first pin seat 204 at the lower portion of the piston 2 to form a semi-cylindrical groove. The opening 206 of the piston 2 is located in the middle of the first pin seat 204 and is vertical to the axis of the first pin hole 205 of the piston pin seat 204, and the width of the opening 206 of the piston 2 is matched with the width of the convex semi-cylinder of the second pin seat 414. In actual production, the piston 2 is made of a stainless-steel metal base, that is, the piston main body 201 is covered with a PEEK layer (namely, first PEEK layer 202) by injection molding to ensure that the spherical top surface 2021 of the piston, the outer cylindrical surface and the two side surfaces 2041 of the first pin seat 204, two side surfaces and the circular arc bottom surface of the semi-cylindrical groove of the first pin seat 204, and the cylindrical surface of the piston shaft 203 are all coated with the PEEK layer, so that the moving part forms a friction pair between the stainless steel and the PEEK layer. The PEEK has abrasion resistance, high strength, corrosion resistance and self-lubricating properties, which is good wear-resistant material, and has good friction matching performance with stainless steel.

As shown in FIGS. 15-18, the rotating disc 4 is provided with a pin seat of the rotating disc 414 corresponding to the piston pin seat 204. A rotating disc shaft 412 protrudes from the center of the lower end of the rotating disc 4, and the rotating disc shaft 412 passes through the center of the spherical surface of the rotating disc. The end of the rotating disc shaft 412 is provided with a slipper 403. The outer peripheral surface between the upper and lower end surfaces of the rotating disc 4 is a spherical surface of the rotating disc, which has the same spherical center with the spherical inner cavity and is close to the spherical inner cavity. The spherical surface of the rotating disc is fitted with the spherical inner cavity in a sealed movable manner. Two ends of the second pin seat 414 both are a semi-cylindrical groove, the middle portion of the second pin seat 414 is a convex semi-cylinder, and a through second pin hole 413 is provided at the center of the semi-cylinder. The central pin 3 is inserted into the second pin hole 413 and the first pin hole 205 to form a cylindrical hinge. Individual matching surfaces of the cylindrical hinge are in a sealing movable fit. Two ends of the cylindrical hinge are respectively in a sealing movable fit with the spherical inner cavity. The piston 2 and the rotating disc 4 form a sealing movable connection through the cylindrical hinge. The two ends of the central pin 3 are respectively provided with an arc insert made of PEEK. The arc shape of the arc insert is matched with the shape of the spherical inner cavity. In the actual production, the rotating disc 4 is made of a stainless-steel metal base, that is, the rotating disc base 401 is coated with a PEEK layer (that is, second PEEK layer 402) by injection molding to ensure that the spherical surface of the rotating disc, slipper 403, and two parallel sides adhered to the sliding groove 601 are all coated with the PEEK layer, so that the moving part forms a friction pair between the stainless steel and the PEEK layer. Two ends of the central pin 3 both are an arc surface. The cylindrical surface of the matching part between the central pin 3 and the pin hole formed by the first pin seat 204 and the second pin seat 414 is made of PEEK. To ensure the strength of the central pin 3, the central pin is coated with a layer of PEEK material on the steel substrate.

As shown in FIGS. 8-12, the main shaft bracket 7 is fixedly connected to the lower end of the cylinder body 5 by screws, and the main shaft 6 is connected to the lower end of the cylinder body 5 through the main shaft bracket 7. The upper end surface of the main shaft 6 is provided with a rectangular sliding groove 601, and the cross-sectional size of the sliding groove 601 is matched with the thickness between the two parallel sides of the slipper 403 on the rotating disc 4. The rotating disc shaft extends from the lower end of the cylinder body 5, and the slipper 403 is inserted into the sliding groove 601 at the upper end of the main shaft 6. The two parallel sides of the slipper 403 are attached to the two sides of the sliding groove 601 to respectively form a sliding fit. A bearing 8 and a sealing ring 9 are provided at the matching part between the lower end of the main shaft 6 and the main shaft bracket 7. The returning groove 701 is provided on the hole wall of the shaft hole of returning groove 701, which is communicated with the second returning channel 502 on the lower end surface of the cylinder body 5, and the bottom surface of the sliding groove 601 is provided with the overflow hole 602. The overflow hole 602 is configured to introduce the liquid at the upper end of the main shaft 6 into the gap (above the seal ring 9) of the matching part between the lower end shaft neck of the main shaft 6 and the main shaft bracket 7, and then flow back from the returning groove 701 to the second returning channel 502. The main shaft bracket 7 provides a support for the rotation of the main shaft, and the lower end of the main shaft 6 is connected with the power mechanism to provide power for the operation of the spherical pump.

The cylinder cover 1 is provided with a first diversion channel 103 and a first returning channel 107. The cylinder body 5 is provided with a second diversion channel 501 and a second returning channel 502. The upper ends of the first diversion channel 103 and the first returning channel 107 are respectively communicated with the suction port 101. The lower ends of the first diversion channel 103 and the first returning channel 107 are both arranged on the flange surface of the lower end of the cylinder cover 1. The upper ends of the second diversion channel 501 and the second returning channel 502 are both arranged on the flange surface of the upper end of the cylinder body 5. The lower end of the first diversion channel 103 is connected to the upper end of the second diversion channel 501, and the upper end of the second returning channel 502 is connected to the first returning channel 107. The lower end of the second returning channel 502 is connected to the returning groove 701. A throttling step 1011 is provided in the suction port 101. The liquid in the suction port 101 is throttled by the throttle surface and mainly enters the working chamber 1001, and the rest liquid enters the cooling channel to cool the system. The first diversion channel 103, the second diversion channel 501, the liquid collection tank, the returning groove 701, the second returning channel 502, and the first returning channel 107 are connected in sequence to form a cooling channel of the spherical pump. The inlet of the cooling channel is communicated with the suction port 101. The cooling liquid flowing from the suction port 101 sequentially passes through the first diversion channel 103 and the second diversion channel 501 to enter the cavity formed by the lower end of the cylinder body, the upper end of the main shaft 6 and the upper end of the main shaft bracket 7 to form a liquid collecting pool, then passes through the returning groove 701, the second returning channel 502 and the first returning channel 107 to flow back into the suction port 101, and then is sucked into the working chamber 1001 to form a cooling circulation system of the spherical pump.

The axes of the piston shaft hole 104 and the rotating disc shaft 412 pass through the center of the spherical inner cavity, and both have an angle $\alpha$ with the axis of the main shaft 6. The two parallel sides of the slipper 403 are symmetrically arranged on two sides of the axis of the rotating disc and parallel to the axis of the cylindrical hinge. When the main shaft 6 rotates to drive the rotating disc 4 and the piston 2, the slipper 403 slides back and forth in the sliding groove 601, and the piston 2 and the rotating disc 4 swing in relation to each other. Two working chambers 1001 with alternating volumes are formed between the upper end surface of the rotating disc 4, the two sides of the piston 2 and the spherical inner cavity. When one working chamber 1001 sucks liquid, the other working chamber 1001 compresses to drain. When the main shaft 6 goes through a full rotation, the piston 2 rotates one circle around the axis of the piston shaft hole 104, and swings once about the axis of the central pin 3 relative to the rotating disc 4, and at the same time, the slipper 403 of the rotating disc 4 swings once in the sliding groove 601 of the main shaft 6 with the swing amplitude of 2*a*, and the two working chambers 1001 each undergo a complete liquid suction or compression discharge process.

As shown in FIGS. 2, 3, and 15-18, a static pressure support is provided between the two parallel sides of the slipper 403 of the rotating disc 4 and the sliding groove 601, which includes a first liquid flow channel 404 and a second liquid flow channel 405 that are both arranged on the rotating disc, and a first pressure-bearing groove 406 and a second pressure-bearing groove 407 respectively arranged on the two parallel sides of the slipper 403.

The rotating disc 4 is provided with the first liquid flow channel 404 and the second liquid flow channel 405. The first liquid flow channel 404 includes a first inlet 4041, a first channel and a first liquid flow channel outlet 4042. The first inlet 4041 is arranged on the upper end surface of the rotating disc 4 and is communicated with a working chamber 1001. The first liquid flow channel outlet 4042 is arranged on one of the two parallel sides of the slipper 403. The first inlet 4041 and the first liquid flow channel outlet 4042 are respectively located on two sides of a plane parallel to the two parallel sides of the slipper 403 where the axis of the rotating disc is located (the plane is parallel to the two parallel sides of the slipper 403 and passes through the center of the spherical surface of the rotating disc). The first channel and the second channel are independent in the rotating disc 4. The slipper 403 is arranged in the sliding groove 601. Two parallel sides of the slipper 403 are respectively in a sliding fit with the two parallel sides of the sliding groove 601. A hydrostatic pressure support is provided between each of the two parallel sides of the slipper 403 and the sliding groove 601 of the spherical pump to facilitate processing and reduce the friction between the slipper 403 and the sliding groove 601. Preferably, a slipper liner 10 is provided between each of the two parallel sides of the slipper 403 and the sliding groove 601, which is plate-shaped and made of PEEK. Two slipper liner 10 are respectively arranged at the two parallel sides of the slipper 403, one side of each slipper liner 10 is attached to a side of the sliding groove 601, and the other side of each slipper liner 10 is attached to one of the two parallel sides of the slipper 403. The slipper liner 10 can be integrated with the slide groove 601 after being fixed. During processing, two sides of each slipper liner 10 are respectively attached to the two sides of the slipper 403, the two parallel sides of the slipper 403 are respectively fit with slipper liners 10 on both sides, and the slipper 403 is configured to slide back and forth along surfaces of the slipper liner 10. The first pressure-bearing groove 406 and the second pressure-bearing groove 407 are respectively provided on the two parallel sides of the slipper 403. The first outlet 4042 is communicated with the first pressure-bearing groove 406, and the second outlet 4052 is communicated with the second pressure-bearing groove 407. Through minimizing the flow area of the first outlet 4042 and the second outlet 4052, to control the liquid flow rate of the hydrostatic pressure support, and avoid the obvious descending of volumetric efficiency. The cross-sectional size of the first pressure-bearing groove 406 is much larger than that of the first outlet 4042, and the cross-sectional size of the second pressure-bearing groove 407 is much larger than that of the second outlet 4052. The first pressure-bearing groove 406 and the second pressure-bearing groove 407 are respectively recessed on the two parallel sides of the slipper 403, generally having a depth of 1 mm. The diameters of the first outlet 4042 and the second outlet 4052 are both 0.3-3 mm. To increase the liquid supporting force of the hydraulic support, The cross-sectional areas of the first pressure-bearing groove 406 and the second pressure-bearing groove 407 are designed as large as possible, that is, the cross-sectional size of the first pressure-bearing groove 406 is over 10 times than that of the first liquid flow channel outlet 4042, and the cross-sectional size of the second pressure-bearing groove 407 is over 10 times than that of the second outlet 4052. During the operation of the spherical pump, when the working chamber 1001 communicated with the first liquid flow channel 404 is at high pressure, the rotor as a whole will unidirectionally squeeze the side of the slipper 403 where the first pressure-bearing groove 406 is provided (namely, the side where the working chamber 1001 at low pressure is located) to reduce the gap between the side of the slipper 403 provided with the first pressure-bearing groove 406 and the slipper liner 10 arranged in the sliding groove 601, and at the same time, the gap between the side of the spherical surface of the rotating disc provided with the first pressure-bearing groove 406 and the spherical inner cavity is correspondingly reduced, the friction force between the side of the slipper provided with the first pressure-bearing groove 406 and the slipper liner 10 is also reduced accordingly, and the friction between the spherical surface of the rotating disc and the spherical inner cavity is increased. However, the high-pressure liquid in the first liquid flow channel 404 enters the first pressure-bearing groove 406 at this time to generate a large hydraulic pressure, which acts as a static pressure support between the side of the slipper 403 and the slipper liner 10, thereby balancing the unidirectional squeezing on the rotor caused by the high pressure of the working chamber connected to the first liquid flow channel 404, increasing the gap between the side of the slipper 403 provided with the first pressure-bearing groove 406 and the slipper liner 10 to a preset value, and normalizing the gap between the spherical surface of the rotating disc and the spherical inner cavity, which lowers the friction between the mating surfaces when the spherical pump is running, reduces the power consumption of the spherical pump, and extends the normal service life of the spherical pump.

In the same way, the working chamber 1001 communicated with the second liquid flow channel 405 is at high pressure, the rotor as a whole will unidirectionally squeeze the side of the slipper 403 where the second pressure-bearing groove 407 is provided (namely, the side where the working chamber 1001 at low pressure is located) to reduce the gap between the side of the slipper 403 provided with the second pressure-bearing groove 407 and the slipper liner 10 arranged in the sliding groove 601, and at the same time, the gap between the side of the spherical surface of the rotating disc provided with the second pressure-bearing groove 407 and the spherical inner cavity is correspondingly reduced, the friction force between the side of the slipper provided with the second pressure-bearing groove 407 and the slipper liner 10 is also reduced accordingly, and the friction between the spherical surface of the rotating disc and the spherical inner cavity is increased. However, the high-pressure liquid in the second liquid flow channel 405 enters the second pressure-bearing groove 407 at this time to generate a large hydraulic pressure, which acts as a static pressure support between the side of the slipper 403 and the slipper liner 10, thereby balancing the unidirectional squeezing on the rotor caused by the high pressure of the working chamber connected to the second liquid flow channel 405, increasing the gap between the side of the slipper 403 provided with the second pressure-bearing groove 407 and the slipper liner 10 to a preset value, and normalizing the gap between the spherical surface of the rotating disc and the spherical inner cavity.

The spherical pump runs cyclically, and the two working chambers 1001 alternately generate high pressure. The first liquid flow channel 404 and the second liquid flow channel 405 are alternately communicated with the high-pressure working chamber 1001, constantly balancing the unbalanced force during the running of the rotor, and adjusting the gaps between the working surfaces, which lowers the friction between the mating surfaces when the spherical pump is running, reduces the power consumption of the spherical pump, and extends the normal service life of the spherical pump.

In this application, the pressure-bearing groove can be rectangular, circular or other shapes, and is arranged at the sphere center of each of the two parallel sides of the slipper 403. The pressure-bearing groove can also be designed as a multi-stage pressure-bearing groove, that is, the multi-stage liquid pressure-bearing groove, which can also be a multi-stage circular groove or a multi-stage rectangular groove. The multi-stage pressure-bearing groove includes a first multi-stage pressure-bearing groove arranged at the center of one of the two parallel sides of the slipper 403, and a second multi-stage pressure-bearing groove arranged at the center of the other of the two parallel sides of the slipper 403. The first liquid flow channel outlet 4042 is connected to the first multi-stage pressure-bearing groove, and the second outlet 4052 is connected to the second multi-stage pressure-bearing groove. The cross-sectional size of the first multi-stage pressure-bearing groove is larger than that of the first liquid flow channel outlet 4042, and the cross-sectional size of the second multi-stage pressure-bearing groove is larger than that of the second outlet 4052. The first multi-stage pressure-bearing groove and the second multi-stage pressure-bearing groove are respectively recessed on the two parallel sides of the slipper 403 is located. Both the first multi-stage pressure-bearing groove and the second multi-stage pressure-bearing groove include a primary pressure-bearing groove and a plurality of auxiliary pressure-bearing grooves. The primary pressure-bearing groove is arranged at the center of the two parallel sides of the slipper 403. The first outlet 4042 is arranged at the bottom of the primary pressure-bearing groove such that the first liquid flow channel 404 is communicated with the first multi-stage pressure-bearing groove. The second outlet 4052 is arranged at the bottom of the primary pressure-bearing groove such that the second liquid flow channel 405 is communicated with the second multi-stage pressure-bearing groove. The plurality of auxiliary pressure-bearing grooves are arranged around the outer circumference of the basic pressure-bearing groove in sequence. The high-pressure liquid in the primary pressure-bearing groove bears the main hydraulic pressure, and passes through the gap between the surface of the slipper liner 10 and one of the two parallel sides of the slipper 403 to partially overflow and leak into the adjacent auxiliary pressure-bearing grooves. The high-pressure liquid in the plurality of auxiliary pressure-bearing grooves also plays a role of static pressure support for the slipper 403, increasing the supporting area, and partially overflows and leaks into the adjacent auxiliary pressure-bearing grooves. The pressure and the amount of the liquid in the multi-stage pressure-bearing groove gradually decreases, from the basic pressure-bearing groove outwards to the plurality of auxiliary pressure-bearing groove. The usage of the multi-stage pressure-bearing groove has the following advantages. The pressure of the basic pressure-bearing groove located in the center of the ring is maximized. The liquid flow introduced from the high-pressure working chamber is effectively used. The liquid static pressure supporting force is stable and evenly distributed, and the static pressure support effect is better.

Figure 19:
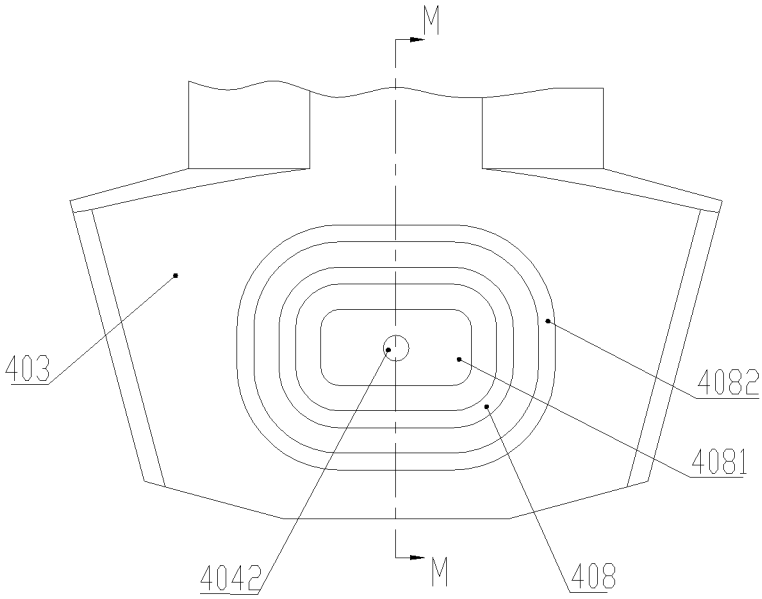
FIG. 19 is a structure diagram of a slipper with a multi-stage rectangular pressure-bearing groove according to an embodiment of the present disclosure.
Figure 20:
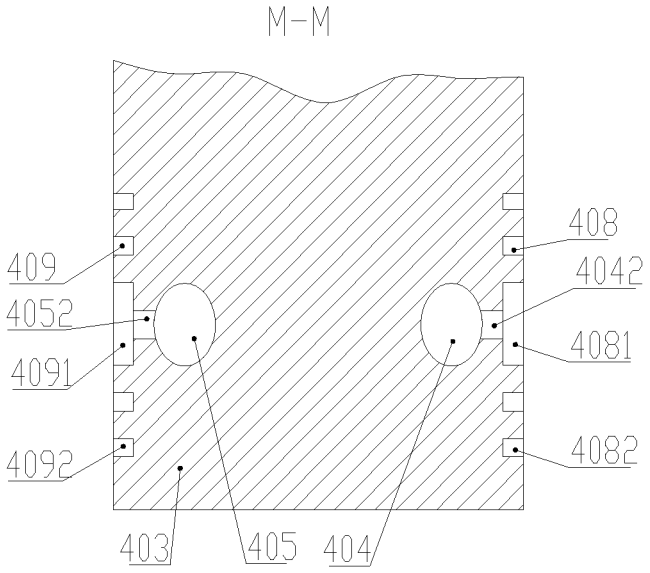
FIG. 20 is a cross-sectional view of the slipper with a multi-stage rectangular pressure-bearing groove along the line M-M in FIG. 19.

As shown in FIGS. 19-20, the first multi-stage pressure-bearing groove and the second multi-stage pressure-bearing groove are independently rectangular. The first multi-stage pressure-bearing groove is the first multi-stage rectangular groove 408, which includes a first rectangular primary pressure-bearing groove 4081 arranged at the center of one of the two parallel sides of the slipper 403 and a first rectangular auxiliary pressure-bearing groove 4082 arranged around the outer circumference of the first rectangular primary pressure-bearing groove 4081. The second multi-stage pressure-bearing groove is the second multi-stage rectangular groove 409, which includes a second rectangular primary pressure-bearing groove 4091 arranged at the center of one of the two parallel sides of the slipper 403 and a second rectangular auxiliary pressure-bearing groove 4092 arranged around the outer circumference of the second rectangular primary pressure-bearing groove 4091. The first multi-stage rectangular groove 408 and the second multi-stage rectangular groove 409 are respectively arranged on the two parallel sides of the slipper 403. The first liquid flow channel outlet 4042 is arranged at the bottom of the first rectangular primary pressure-bearing groove 4081 of the first multi-stage rectangular groove 408 such that the first multi-stage rectangular groove 408 is communicated with the first liquid flow channel 404. The second outlet 4052 is arranged at the bottom of the second rectangular primary pressure-bearing groove 4091 of the second multi-stage rectangular groove 409 such that the second multi-stage rectangular groove 409 is communicated with the second liquid flow channel 405.

Figure 21:
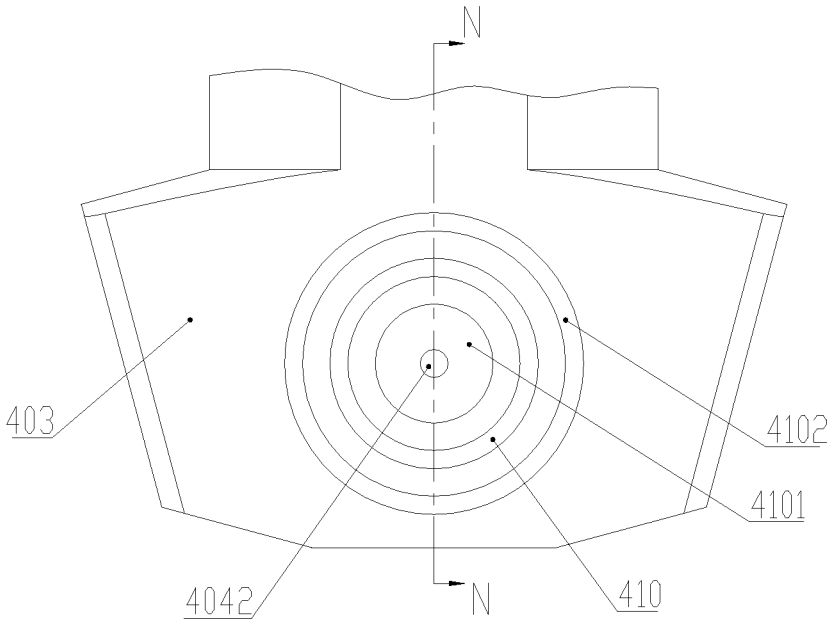
FIG. 21 is a structure diagram of a slipper with a multi-stage circular pressure-bearing groove according to an embodiment of the present disclosure.
Figure 22:
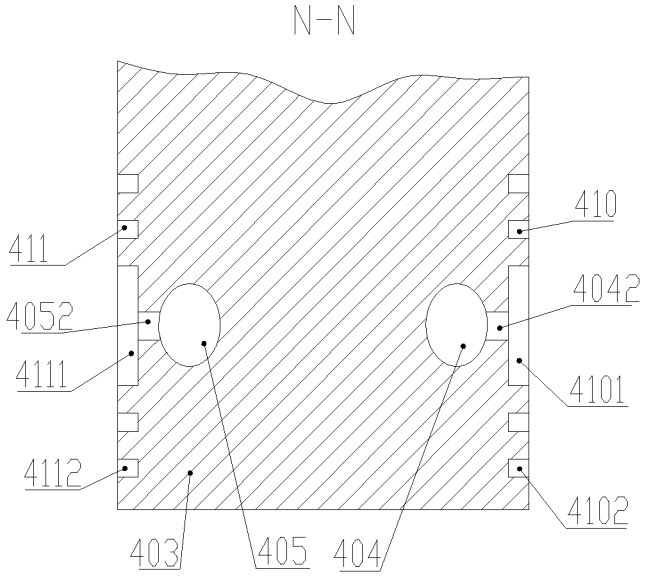
FIG. 22 is a cross-sectional view of the slipper with a multi-stage circular pressure-bearing groove along the line N-N in FIG. 21.

As shown in FIGS. 21-22, the first multi-stage pressure-bearing groove and the second multi-stage pressure-bearing groove are independently circular. The first multi-stage pressure-bearing groove is the first multi-stage circular groove 410, which includes a first circular primary pressure-bearing groove 4101 arranged at the center of one of the two parallel sides of the slipper 403, and a first circular auxiliary pressure-bearing groove 4102 arranged around the outer circumference of the first circular primary pressure-bearing groove 4101. The second multi-stage pressure-bearing groove is a second multi-stage circular groove 411, which includes a second circular primary pressure-bearing groove 4111 arranged at the center of one of the two parallel sides of the slipper 403, and a second circular auxiliary pressure-bearing groove 4112 arranged around the outer circumference of the second circular primary pressure-bearing groove 4111. The first multi-stage circular groove 410 and the second multi-stage circular groove 411 are respectively arranged on the two parallel sides of the slipper 403. The first outlet 4042 is arranged at the bottom of the first circular primary pressure-bearing groove 4101 of the first multi-stage circular groove 410 such that the first multi-stage circular groove 410 is communicated with the first liquid flow channel 404. The second outlet 4052 is arranged at the bottom of the second circular primary pressure-bearing groove 4111 of the second multi-stage circular groove 411 such that the second multi-stage circular groove 411 is communicated with the second liquid flow channel 405.

To simplify the processing, the first liquid flow channel 404 and the second liquid flow channel 405 both can be combined by several straight channels when processing. The processing of the first liquid flow channel 404 is described as follows. A though hole is processed by drilling downward at a certain angle from the upper end of the rotating disc and then drilling upward at a certain angle from the lower end of the slipper 403. After that, a drilling operation is performed at the bottom of the liquid pressure-bearing groove on the side of the slipper 403 to form the hole of the first liquid flow channel outlet 4042, communicated with the above-mentioned though hole. At last, the hole at the lower end of the slipper 403 is blocked. The processing of the second liquid flow channel 405 is in the same way, described as follows. A though hole is processed by drilling downward at a certain angle from the upper end of the rotating disc and then drilling upward at a certain angle from the lower end of the slipper 403. After that, a drilling operation is performed at the bottom of the liquid pressure-bearing groove on the side of the slipper 403 to form the hole of the second outlet 4052, communicated with the above-mentioned though hole. At last, the hole at the lower end of the slipper 403 is blocked.

The above embodiments are merely illustrative, and are not intended to limit the present application. Any changes, improvements, replacements and modifications made by those skilled in the art without departing from the spirit and scope of the present application shall fall within the scope of the present application defined by the appended claims. Moreover, it should be noted that individual features described above can be adopted alone or in combination. Therefore, on the premise of the absence of contradiction, the combination of technical features in various embodiments should fall within the scope of the present application.

What is claimed is:

1. A hydrostatic pressure support for a rotor of a spherical pump, comprising:

a first liquid flow channel;

a second liquid flow channel; and a plurality of pressure-bearing grooves;

wherein the first liquid flow channel and the second liquid flow channel are both arranged on a rotating disc; an inner surface of two parallel sides of a slipper of the rotating disc are respectively provided with each of the plurality of pressure-bearing grooves; the first liquid flow channel comprises a first inlet and a first outlet; the first inlet is communicated with a first working chamber of the spherical pump; the second liquid flow channel comprises a second inlet and a second outlet; the second inlet is communicated with a second working chamber of the spherical pump; the first outlet and the second outlet are respectively communicated with each of the plurality of pressure-bearing grooves provided on the inner surface of two parallel sides of the slipper; a slipper liner is arranged between each of the two parallel sides of the slipper and a sliding groove of the spherical pump; each of the two parallel sides of the slipper respectively fit with the slipper liner; the slipper is configured to slide back and forth in the sliding groove along a surface of the slipper liner; and the hydrostatic pressure support is arranged between each of the two parallel sides of the slipper and a corresponding slipper liner.

2. The hydrostatic pressure support of claim 1, wherein the first inlet is arranged on an upper end surface of the rotating disc; the first outlet is arranged on one of the two parallel sides of the slipper; the first inlet and the first outlet are respectively located on two sides of a plane parallel to the two parallel sides of the slipper where an axis of the rotating disc is located; the second inlet is arranged on the upper end surface of the rotating disc; the second outlet is arranged on the other of the two parallel sides of the slipper; and the second inlet and the second outlet are respectively located on two sides of the plane parallel to the two parallel sides of the slipper where the axis of the rotating disc is located.

3. The hydrostatic pressure support of claim 1, wherein the plurality of pressure-bearing grooves consist of a first pressure-bearing groove and a second pressure-bearing groove; the first outlet is communicated with the first pressure-bearing groove, and the second outlet is communicated with the second pressure-bearing groove; and a cross-sectional size of the first pressure-bearing groove is larger than that of the first outlet, and a cross-sectional size of the second pressure-bearing groove is larger than that of the second outlet.

4. The hydrostatic pressure support of claim 3, wherein the cross-sectional size of the first pressure-bearing groove is equal to or larger than 10 times a cross-sectional size of the first outlet, and the cross-sectional size of the second pressure-bearing groove is equal to or larger than 10 times a cross-sectional size of the second outlet.

5. The hydrostatic pressure support of claim 1, wherein the plurality of pressure-bearing grooves consist of a first multi-stage pressure-bearing groove and a second multi-stage pressure-bearing groove; the first outlet is communicated with the first multi-stage pressure-bearing groove, and the second outlet is communicated with the second multi-stage pressure-bearing groove; a cross-sectional size of the first multi-stage pressure-bearing groove is larger than that of the first outlet, and a cross-sectional size of the second multi-stage pressure-bearing groove is larger than that of the second outlet; each of the first multi-stage pressure-bearing groove and the second multi-stage pressure-bearing groove comprises a primary pressure-bearing groove and a plurality of auxiliary pressure-bearing grooves; the primary pressure-bearing groove is arranged at a middle of each of the two parallel sides of the slipper; a bottom of the primary pressure-bearing groove is communicated with the first outlet or the second outlet; and the plurality of auxiliary pressure-bearing grooves are arranged at a periphery of the primary pressure-bearing groove in sequence.

6. The hydrostatic pressure support of claim 5, wherein the first multi-stage pressure-bearing groove and the second multi-stage pressure-bearing groove are independently rectangular or circular.

7. The hydrostatic pressure support of claim 1, wherein the plurality of pressure-bearing grooves are rectangular or circular.

8. A spherical pump having a hydrostatic pressure support, comprising:

a cylinder body having a semi-spherical inner cavity;

a cylinder cover having a semi-spherical inner cavity;

a piston;

a rotating disc;

a main shaft; and a main shaft bracket;

wherein the cylinder body is provided with a through hole communicated with an outside, and the through hole is configured to allow a rotating disc shaft to pass through;

a lower end of the cylinder cover is fixedly connected to an upper end of the cylinder body to form a spherical inner cavity; an inner spherical surface of the cylinder cover is provided with a piston shaft hole, a waist-shaped inlet hole, and a waist-shaped outlet hole; the waist-shaped inlet hole and the waist-shaped outlet hole are arranged in an annular area perpendicular to an axis of the piston shaft hole; and the waist-shaped inlet hole is in communication with a suction port at an upper end of the cylinder cover, and the waist-shaped outlet hole is in communication with a discharge port at the upper end of the cylinder cover;

the piston comprises a spherical top surface, two side surfaces at an angle, and a first pin seat; the first pin seat is provided at a lower portion of the two side surfaces; a piston shaft protrudes from a middle of the spherical top surface of the piston; an axis of the piston shaft passes through a sphere center of the spherical top surface of the piston; and the spherical top surface of the piston and the spherical inner cavity have the same sphere center, and the spherical top surface of the piston is in a sealing movable fit with the spherical inner cavity;

an outer circumference between an upper portion and a lower end surface of the rotating disc is configured as a spherical surface; the spherical surface of the rotating disc and the spherical inner cavity have the same sphere center, and the spherical surface of the rotating disc is in a sealing movable fit with the spherical inner cavity; a second pin seat corresponding to the first pin seat is provided at the upper portion of the rotating disc; the rotating disc shaft protrudes from a center of a lower end of the rotating disc, and the rotating disc shaft passes through a sphere center of the spherical surface of the rotating disc; and a slipper is fixedly provided at an end of the rotating disc shaft;

the main shaft is connected to a lower end of the cylinder body through the main shaft bracket; the main shaft bracket is fixedly connected to the lower end of the cylinder body, and is configured to provide support for rotation of the main shaft; and an upper end surface of the main shaft is provided with a sliding groove; and the axis of the piston shaft hole and an axis of the rotating disc shaft both pass through a sphere center of the spherical inner cavity; the axis of the piston shaft hole has an angle with respect to an axis of the main shaft; the second pin seat and the first pin seat are matched to form a cylindrical hinge; individual matching surfaces of the cylindrical hinge are in a sealing movable fit; the rotating disc shaft extends from the lower end of the cylinder body, and the slipper is inserted into the sliding groove at the upper end of the main shaft; two parallel sides of the slipper are respectively in a sliding fit with two sides of the sliding groove; the two parallel sides of the slipper are symmetrically arranged with respect to an axis of the rotating disc, and are parallel to an axis of the cylindrical hinge; when the main shaft rotates to drive the rotating disc and the piston, the slipper slides back and forth in the sliding groove, and the piston and the rotating disc swing in relation to each other; two working chambers with alternately-variable volumes are formed between an upper end surface of the rotating disc, the two side surfaces of the piston and the spherical inner cavity;

the hydrostatic pressure support is arranged between each of the two parallel sides of the slipper and the sliding groove; the hydrostatic pressure support comprises a first liquid flow channel, a second liquid flow channel, and a plurality of pressure-bearing grooves; the first liquid flow channel and the second liquid flow channel are both arranged on the rotating disc; an inner surface of the two parallel sides of the slipper are respectively provided with each of the plurality of pressure-bearing grooves; the first liquid flow channel comprises a first inlet and a first outlet; the first inlet is communicated with one of the two working chambers; the second liquid flow channel comprises a second inlet and a second outlet; the second inlet is communicated with the other of the two working chambers; and the first outlet and the second outlet are respectively communicated with each of the plurality of pressure-bearing grooves provided on the inner surface of the two parallel sides of the slipper.

9. The spherical pump of claim 8, wherein the first inlet is arranged on the upper end surface of the rotating disc; the first outlet is arranged on one of the two parallel sides of the slipper; the first inlet and the first outlet are respectively located on two sides of a plane parallel to the two parallel sides of the slipper where the axis of the rotating disc is located; the second inlet is arranged on the upper end surface of the rotating disc; the second outlet is arranged on the other of the two parallel sides of the slipper; the second inlet and the second outlet are respectively located on the two sides of the plane parallel to the two parallel sides of the slipper where the axis of the rotating disc is located.

10. The spherical pump of claim 8, wherein a slipper liner is arranged between each of the two parallel sides of the slipper and the sliding groove; each of the two parallel sides of the slipper respectively fit with the slipper liner, and the slipper is configured to slide back and forth along a surface of the slipper liner.

11. The spherical pump of claim 10, wherein the first pin seat is of a semi-cylindrical structure, and a middle of the first pin seat is provided with a recess; a first through pin hole is provided on the first pin seat, and penetrates the first pin seat along a central axis of the first pin seat; two ends of the second pin seat are respectively configured as a semi-cylindrical groove, and a middle of the second pin seat is a raised semi-cylinder; a second through pin hole is provided at an axis of the raised semi-cylinder; a central pin is inserted into the second through pin hole and the first through pin hole to form the cylindrical hinge; and two ends of the central pin are configured as arc-shaped to fit the spherical inner cavity.

12. The spherical pump of claim 11, wherein the piston, the spherical surface of the rotating disc, an outer cylindrical surface of the piston shaft, and a semi-cylindrical surface of the first pin seat are respectively coated with a poly(ether-ether-ketone) (PEEK) layer; the slipper liner is made of PEEK; a part where the main shaft and the lower end of the cylinder body are matched is provided with a cylinder liner; and the cylinder liner is made of PEEK.

13. The spherical pump of claim 8, wherein the plurality of pressure-bearing grooves consist of a first pressure-bearing groove and a second pressure-bearing groove; the first outlet is communicated with the first pressure-bearing groove, and the second outlet is communicated with the second pressure-bearing groove; and a cross-sectional size of the first pressure-bearing groove is larger than that of the first outlet, and a cross-sectional size of the second pressure-bearing groove is larger than that of the second outlet.

14. The spherical pump of claim 8, wherein the plurality of pressure-bearing grooves consist of a first multi-stage pressure-bearing groove and a second multi-stage pressure-bearing groove; the first outlet is communicated with the first multi-stage pressure-bearing groove, and the second outlet is communicated with the second multi-stage pressure-bearing groove; a cross-sectional size of the first multi-stage pressure-bearing groove is larger than that of the first outlet, and a cross-sectional size of the second multi-stage pressure-bearing groove is larger than that of the second outlet; each of the first multi-stage pressure-bearing groove and the second multi-stage pressure-bearing groove comprises a primary pressure-bearing groove and a plurality of auxiliary pressure-bearing grooves; the primary pressure-bearing groove is arranged at a center of each of the two parallel sides of the slipper; a bottom of the primary pressure-bearing groove is communicated with the first outlet or the second outlet; and the plurality of auxiliary pressure-bearing grooves are arranged at a periphery of the primary pressure-bearing groove in sequence.

15. The spherical pump of claim 14, wherein the first multi-stage pressure-bearing groove and the second multi-stage pressure-bearing groove are independently rectangular or circular.

16. The spherical pump of claim 8, wherein the plurality of pressure-bearing grooves are rectangular or circular.

17. The spherical pump of claim 8, wherein a throttling step is provided in the suction port; liquid in the suction port is throttled by a throttling surface of the throttling step and enters a liquid-suction working chamber of the two working chambers and a first diversion channel; an inlet of the first diversion channel is communicated with the suction port; the cylinder cover is provided with the first diversion channel and a first returning channel;

the cylinder body is provided with a second diversion channel and a second returning channel; the main shaft bracket is provided with a returning groove; a cooling liquid flowing from the suction port successively passes through the first diversion channel and the second diversion channel to enter a cavity formed by the lower end of the cylinder body, an upper end of the main shaft, and the upper end of the main shaft bracket, and then successively passes through the returning groove, the second returning channel and the first returning channel to flow back to the suction port to be sucked into the liquid-suction working chamber.

* * * * *